US006094824A

United States Patent [19]

Takeshita

[11] Patent Number: 6,094,824

[45] Date of Patent: Aug. 1, 2000

[54] ROTARY CUTTER

[75] Inventor: Takahiro Takeshita, Inuyama, Japan

[73] Assignee: Kai R&D Center Co., Ltd., Gifu-ken, Japan

[21] Appl. No.: 09/156,281

[22] Filed: Sep. 17, 1998

[30] Foreign Application Priority Data

Apr. 16, 1998 [JP] Japan ..... 10-106652

[51] Int. Cl.[7] ..... B26B 25/00; B26B 29/02

[52] U.S. Cl. ..... 30/276; 30/292; 30/307; 30/319

[58] Field of Search ..... 30/276, 162, 292–3, 30/307, 319, 347, 283–5, 295, 391

[56] References Cited

U.S. PATENT DOCUMENTS

| | | | |
|---|---|---|---|
| Re. 32,501 | 9/1987 | Okada | 30/292 |
| 3,439,419 | 4/1969 | Fleming | 30/162 |
| 4,301,594 | 11/1981 | Okada | 30/292 X |
| 4,601,103 | 7/1986 | Sugiyama | 30/162 |
| 5,101,564 | 4/1992 | Melter | 30/319 |
| 5,299,355 | 4/1994 | Boda et al. | 30/162 |
| 5,355,588 | 10/1994 | Brandenburg, Jr. et al. | 30/319 |
| 5,493,781 | 2/1996 | Saito | 30/162 |
| 5,711,077 | 1/1998 | Shulz et al. | 30/319 X |
| 5,765,289 | 6/1998 | Shulz et al. | 30/309 |

FOREIGN PATENT DOCUMENTS

| | | |
|---|---|---|
| 3446161A1 | 2/1986 | Germany . |
| 6-59 Y2 | 1/1994 | Japan . |
| 63-28647 | 3/1998 | Japan . |

*Primary Examiner*—M. Rachuba
*Assistant Examiner*—T. Anthony Vaughn
*Attorney, Agent, or Firm*—Crompton, Seager & Tufte, LLC

[57] ABSTRACT

A rotary cutter has a handle, a rotary blade having a cutting edge, a protective member for covering the blade, a lock mechanism for locking the protective member, and a brake mechanism for applying rotational resistance to the blade. The blade is rotatably supported by the handle. The protective member moves between a first position, in which the protective member is held to prevent exposure of the cutting edge of the blade, and a second position, in which the protective member permits exposure of the edge of the blade. The lock mechanism moves between a lock position, in which the protective member is positioned in the first position, and an unlock position, in which the protective member is positioned in the second position. The control element is common to both the lock mechanism and the brake mechanism for operating both the lock mechanism and the brake mechanism.

10 Claims, 5 Drawing Sheets

Right side
X
Front side
Rear side
Left side
Y
27
21
2
3
12
10
1

Left side
X
Front side
Rear side
Right side
Y
21
3
2
13
17
19
18
8 (R)
11
1

21
3
2
13
17
19
18
8 (P)
11
1

21
3
2
13
17
19
18
8 (Q)
11
1

ROTARY CUTTER

BACKGROUND OF THE INVENTION

The present invention relates to a rotary cutter having a rotary blade with a cutting edge for cutting a material as the rotary blade rotates.

This type of rotary cutter is illustrated in Japanese examined utility model publication No.6-59. The rotary cutter has a protective member, which prevents exposure of the cutting edge of the rotary blade while the rotary cutter is not in use. The rotary cutter further includes a brake mechanism for applying rotational resistance to the blade. The brake mechanism has a shoe element that contacts the blade to exert frictional resistance on the blade. The shoe element is moveable toward or away from the blade. The degree of rotational resistance of the blade may be changed by rotating the brake mechanism clockwise or counterclockwise to move the shoe element away from or toward the blade. The rotary cutter also includes a lock mechanism for locking the protective member. The lock mechanism is operated with a knob, which is independent from the brake mechanism.

In the prior art rotary cutter, the brake mechanism and the lock mechanism are independently formed by separate parts and are independently operated to achieve their respective functions. Therefore, construction and operation of the rotary cutter is complicated due to the number of parts required.

SUMMARY OF THE INVENTION

Accordingly, it is an objective of the present invention to provide a rotary cutter that has a simplified construction and is more easily handled.

For achieving the objective of the present invention, a rotary cutter in accordance with the present invention has a handle, a rotary blade having a cutting edge, a protective member for covering the blade, a lock mechanism for locking the protective member, and a brake mechanism for applying rotational resistance to the blade. The rotary blade is rotatably supported by the handle. The protective member moves in at least one direction. Furthermore, the protective member moves between a first position, in which the protective member is locked to prevent exposure of the cutting edge of the blade, and a second position, in which the protective member permits exposure of the edge of the blade. The lock mechanism moves between a lock position, in which the protective member is held in the first position, and an unlock position, in which the protective member is released. The control element is common to both the lock mechanism and the brake mechanism for operating both the lock mechanism and the brake mechanism.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objectives and advantages thereof, may best be understood by reference to the following description of the presently preferred embodiments together with the accompanying drawings in which:

FIG. 1(*b*) is a bottom view of the cutter shown in FIG. 1(*a*), showing the control element in a locked position;

FIG. 1(*c*) is another bottom view of the cutter shown in FIG. 1(*a*), showing the control element in an unlocked position;

FIG. 1(*d*) is a further bottom view of the cutter shown in FIG. 1(*a*), showing the control element in an unlocked position;

FIG. 2(*b*) is a partial, enlarged cross-sectional view taken along line 2*b*—2*b* in FIG. 2(*a*);

FIG. 2(*c*) is an enlarged view of a portion of FIG. 2(*a*);

FIG. 3(*b*) is a bottom view like FIG. 3(*a*) with further parts removed;

FIG. 4(*b*) is a partial, enlarged cross-sectional view taken along line 4*b*—4*b* in FIG. 4(*a*);

FIG. 4(*c*) is an enlarged view of a portion of FIG. 4(*a*);

FIG. 5(*b*) is a view like in FIG. 5(*a*), showing the control element in an unlocked position.

DETAILED DESCRIPTION OF THE PREFERRED EMBODIMENTS

A rotary cutter according to a first embodiment of the present invention will be described with reference to FIGS. 1 to 4.

Figure 1:
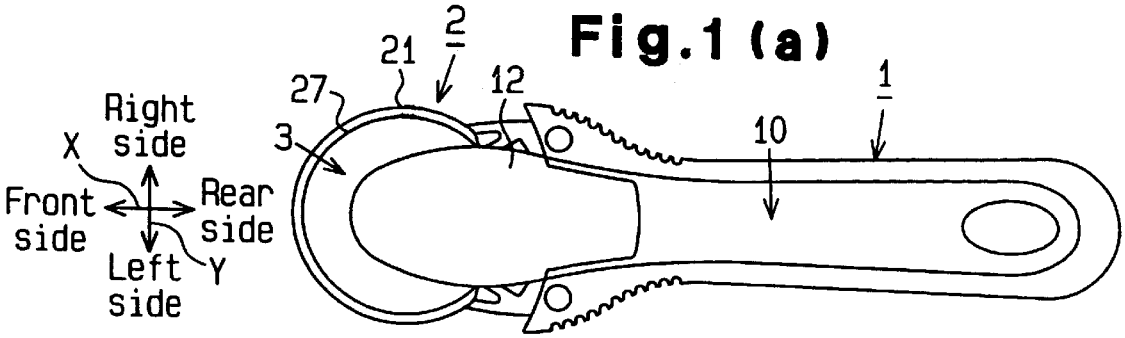
FIG. 1(*a*) is a top view of a rotary cutter according to a first embodiment of the present invention.
Figure 1:
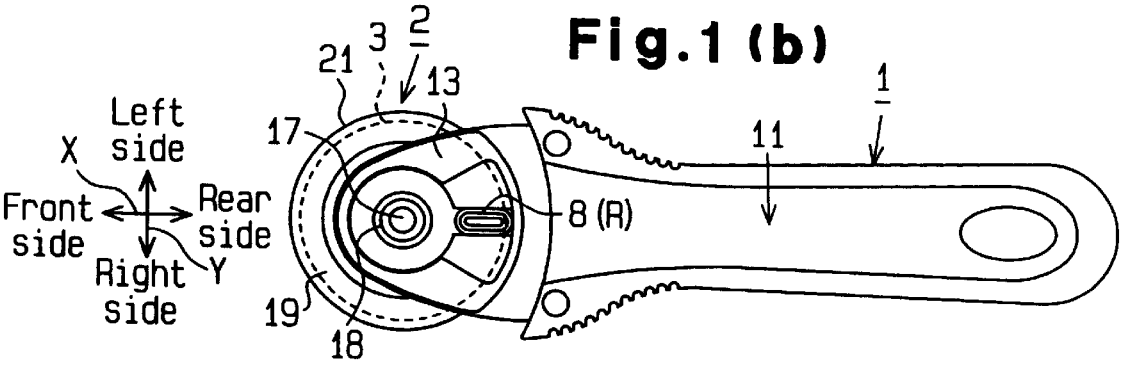
Figure 1:
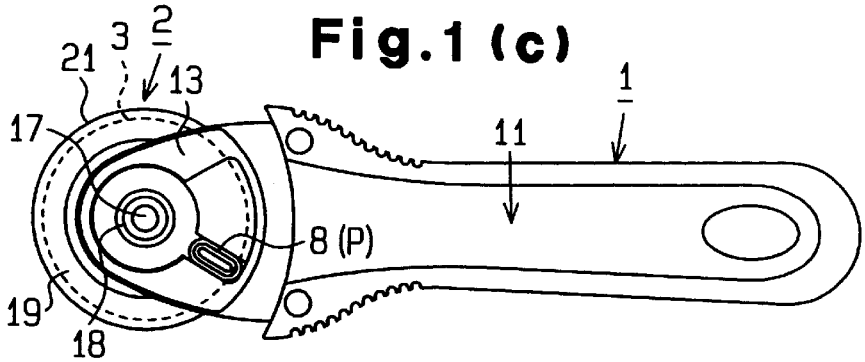
Figure 1:
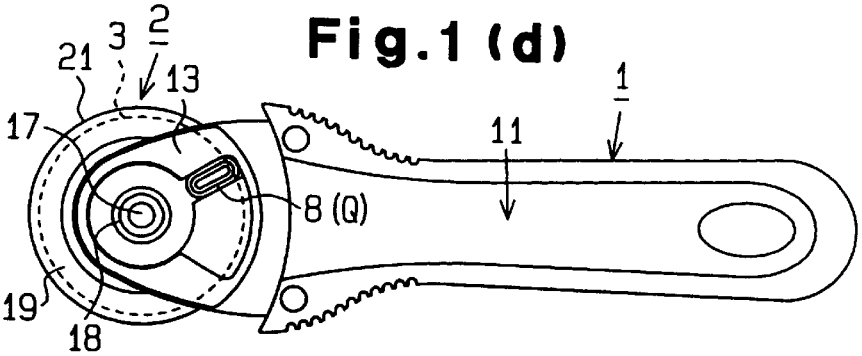
Figures 2A, 2B, 2C:
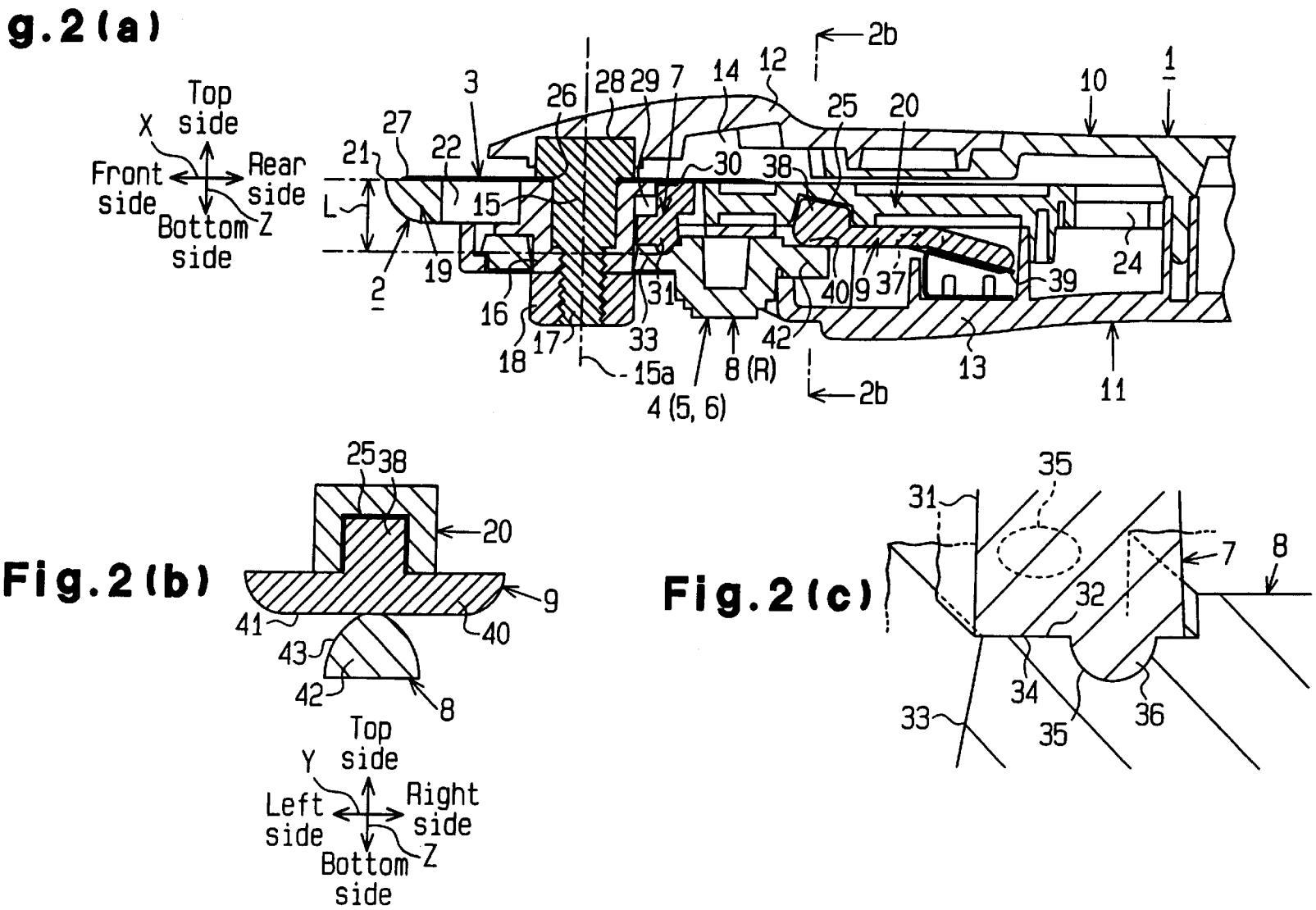
FIG. 2(*a*) is a partial longitudinal sectional view of the cutter shown in FIG. 1(*b*), showing the control element in a locked position.

The rotary cutter shown in FIGS. 1 to 4 has a handle 1, a protective member 2, a circular rotary blade 3 with a cutting edge 27 and a control mechanism 4. As shown in FIG. 2(*a*), the control-mechanism 4 includes a brake mechanism 5 for applying rotational resistance to the blade 3 and a lock mechanism 6 for locking the protective member 2 to prevent exposure of the cutting edge 27 of the blade 3 while the cutter is not in use. The brake mechanism 5 has a shoe element 7 and a control element 8. The lock mechanism 6 has an engaging element 9 and the control element 8. The control element 8 is common to both the lock mechanism 6 and the brake mechanism 5.

The handle 1 has a top part 10 and a bottom part 11. A first support element 12 is attached to the top part 10 of the handle 1. A second support element 13 is formed at a distal end of the bottom part 11 to oppose the first support element 12. A support space 14 is defined between the first and second support elements 12 and 13. One end of a spindle 15 is attached to an interior side of the first support element 12. A spindle support 16 is formed in the second support element 13. The spindle 15 extends through and protrudes from the spindle support 16. Male threads 17 are formed on the spindle 15. A nut 18 is threaded to the male threads 17 outside of the spindle support 16.

For reference purposes, the axis 15*a* of the spindle 15 is referred as the vertical axis Z as indicated by the diagram on the left side of FIG. 2(*a*). The upper side and the lower side of the handle 1 in FIG. 2(*a*) are respectively referred as the top side and the bottom side of the cutter. The longitudinal axis of the handle 1 is referred as the X axis. The left end and the right end of the handle 1 in FIG. 1(*a*) are respectively referred to as the front end and the rear end. The Y axis is thus parallel to the plane of the blade 3 and perpendicular to the X axis. Referring to FIG. 1(*a*), the upper side is the right side of the cutter and the lower side is the left side of the cutter.

Figure 3A:
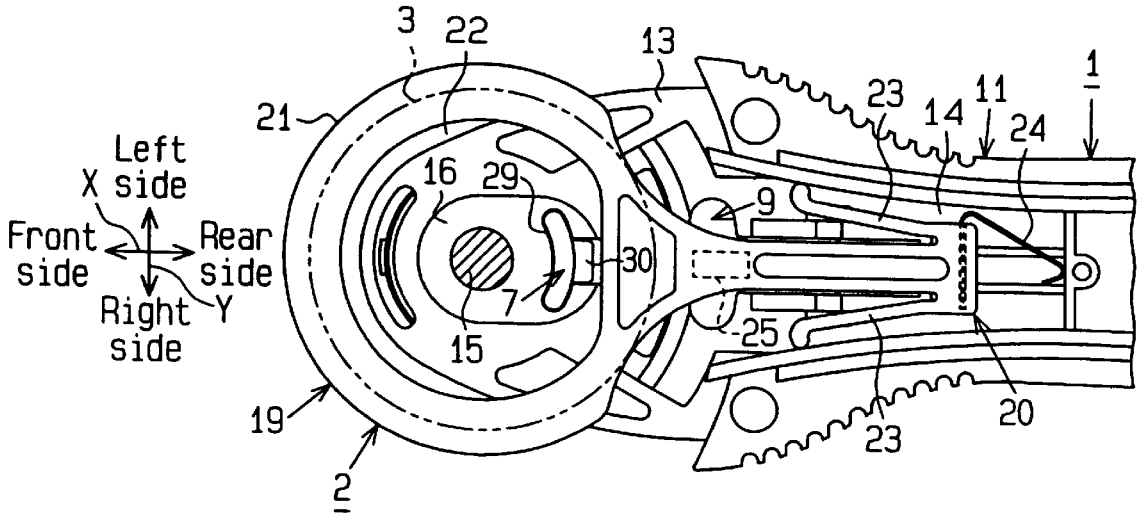
FIG. 3(*a*) is a bottom view like FIG. 1(*b*) with parts removed.
Figure 3B:
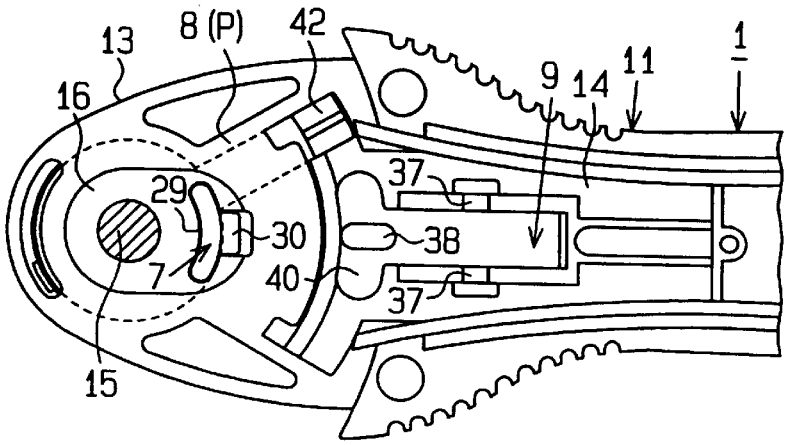

As shown in FIG. 3(*a*), the protective member 2 has a ring section 19 and a support arm 20, which extends from a rear part of the ring section 19. The protective member 2 is received in the support space 14. An edge protector 21, which is substantially arcuate, is formed on the front of the ring section 19. Furthermore, an arcuate space 22 is formed inside of the ring section 19. The spindle support 16 of the bottom part 11 is arranged in this space 22. A pair of first leaf springs 23 are formed on the sides of the support arm 20. A second leaf spring 24 is attached to the rear end of the support arm 20. The first springs 23 engage the handle 1 in the support space 14. The protective member 2 moves in the lateral or Y direction against the force of one of the first leaf springs 23. The second leaf spring 24 engages the handle 1 in the support space 14. The protective member 2 moves in the rightward direction of FIG. 3(*a*) against the force of the second leaf spring 24.

The blade 3 has a support hole 26 in its center. The spindle 15 is inserted through the support hole 26. The bottom surface of the blade 3 contacts the top surfaces of the spindle support 16 and the ring section 19. The cutting edge 27 of the blade 3 is normally within the periphery of the edge protector 21. After the nut 18 is screwed tightly on the male threads 17 of the spindle 15 to set the blade 3 in a predetermined position, the blade 3 is rotatably supported between a head 28 of the spindle 15 and the spindle support 16 about the axis 15*a*.

With reference to FIG. 2(*a*), the brake mechanism 5 will now be described in detail. The brake mechanism 5 includes the shoe element 7 and the control element 8. A guide hole 29 is formed at the rear side of the spindle support 16 to extend through the second support element 13 in the vertical direction Z, and the upper end of the guide hole 29 opens towards the blade 3 (see FIG. 3(*a*)). The guide hole 29 also extends arcuately about the axis 15*a* of the spindle 15, as best seen in FIGS. 3(*a*) and 3(*b*). The shoe element 7 of the brake mechanism 5 is accommodated in the guide hole 29. The shoe element 7 includes a top part 30, which protrudes from the upper end of the guide hole 29, and a bottom part 31, which protrudes from a lower end of the guide hole 29. The top part 30 engages the blade 3 at a position that is radially spaced from the axis 15*a* of the spindle 15. The bottom part 31 has a pushing surface 32 (FIG. 2(*c*)), which engages the control element 8.

The control element 8, which is arranged on the outside of the handle 1, is rotatably supported by the spindle 15 about the axis 15*a*. The control element 8 has a first cam, or ramp section 33, that engages the bottom part 31 of the shoe element 7. The ramp section 33 has a ramp surface 34, which is opposed to the pushing surface 32 of the shoe element 7.

Both the ramp surface 34 of the control element 8 and the pushing surface 32 of the shoe element 7 are designed to extend along an arc, the center of which is the axis 15*a* of the spindle 15, and their facing surfaces are inclined relative to a plane perpendicular to the axis 15*a* of the spindle 15. In other words, the ramp surface 34 is a helical cam surface. The shoe element 7 follows the ramp surface like a cam follower. When the control element 8 is pivoted, the shoe element 7 is cammed to move in the direction of the Z axis, due to the inclination of the ramp surface 34. This will change the distance L between the bottom of the protrusion 36 and the blade supporting surface of the spindle support 16. The smaller the distance L, the greater the rotational resistance of the blade 3, caused by frictional engagement of the top part 30 of the shoe element 7 against the bottom surface of the blade 3, will be. Therefore, it is possible to change the rotational resistance of the blade 3 by pivoting the control element 8. The rotational resistance of the blade 3 is minimized when the control element 8 is positioned at a first angular position P as shown in FIG. 1(*c*). The rotational resistance of the blade 3 is maximized when the control element 8 is positioned at a second angular position Q as shown in FIG. 1(*d*). The rotational resistance of the blade 3 is intermediate when the control element 8 is positioned at a third angular position R as shown in FIG. 1(*b*).

A plurality of recesses 35 are formed in the ramp surface 34 of the control element 8 along the circular arc, and each recess 35 is located a different distance from a blade supporting surface, or the top surface, of the spindle support 16. A protrusion 36 protrudes downwardly from the pushing surface 32 of the shoe element 7 to engage with one of the recesses 35. This structure forms a detent mechanism for producing mild resistance to movement of the control element 8 at predetermined angular intervals. As the control element 8 is rotated clockwise or counterclockwise around the axis 15*a* of the spindle 15, the recesses 35 will move about the axis 15*a* to engage with the protrusion 36 sequentially for creating resistance stops while the shoe element 7 moves away from or toward the blade 3 in the vertical direction Z.

With reference to FIG. 2(*a*), the lock mechanism 6 will now be described in detail. The lock mechanism 6 includes the engaging element 9 and the control element 8. Within the support space 14 of the handle 1, the engaging element 9 is pivotally supported below the support arm 20 of the protective member 2 by a pair of coaxial pivots 37 (FIG. 3(*b*)) to pivot in the vertical direction Z. As shown in FIG. 2(*a*), a recess 25 is formed at the bottom side of the support arm 20 near the ring section 19. A protrusion 38 extends upwardly from a front end of the engaging element 9 to engage the recess 25. A third leaf spring 39 is arranged between the rear end of the engaging element 9 and the second support element 13 to urge the protrusion 38 away from the recess 25. As shown in FIG. 2(*b*), a follower 40 is formed to extend in the Y direction at the front bottom part of the engaging element 9. The follower 40 has an engagement surface 41, which faces and engages the control element 8.

The control element 8 has a second cam section 42 that engages the follower 40 of the engaging element 9. A locking cam 43 is formed on the second cam section 42. The locking cam 43 is semi-oval in cross-section, as shown in FIG. 2(*b*).

As shown in FIGS. 2(*a*) and 2(*b*), when the control element 8 is positioned at the third position R, the locking cam 43 of the control element 8 engages the engagement surface 41 of the engaging element 9 to urge the follower 40 of the engaging element 9 upwardly against the force of the third leaf spring 39. Therefore, the protrusion 38 of the engaging element 9 enters and engages the recess 25 of the support arm 20, so movement of the protective member 2 is prevented, and the protective member 2 is thus held in a locked position. As a result, exposure of the cutting edge 27 of the blade 3 is prevented even if a force is applied to the protective member 2.

Figure 4:
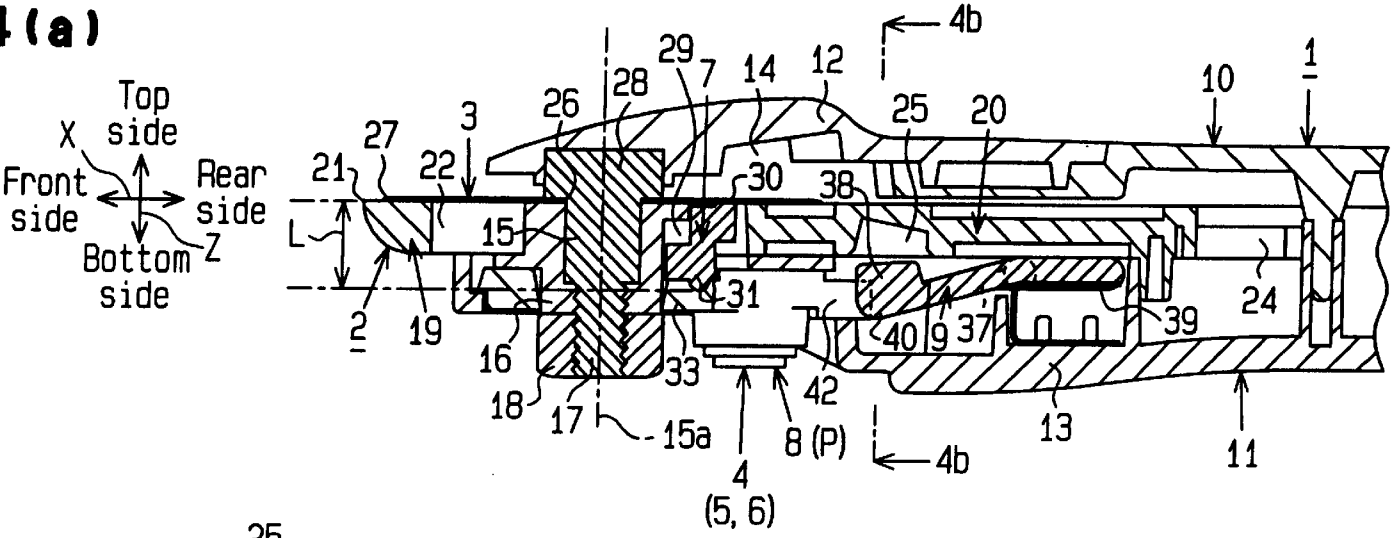
FIG. 4(*a*) is a view like FIG. 2(*a*), showing the control element in an unlocked position.
Figure 4:
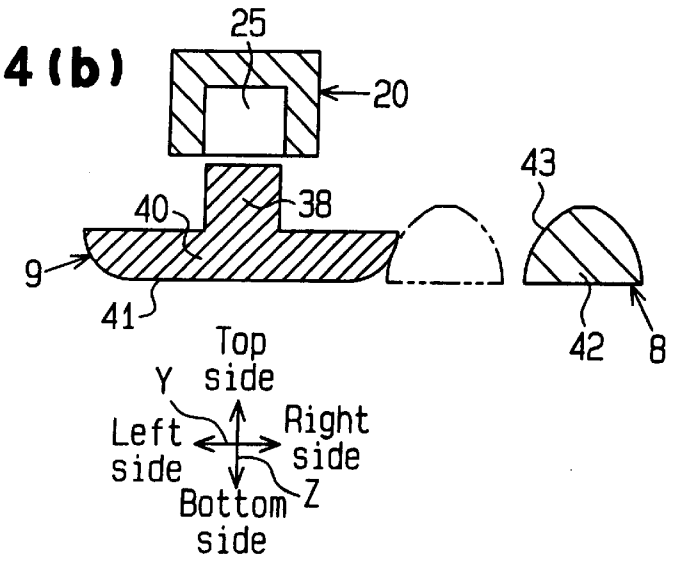
Figure 4:
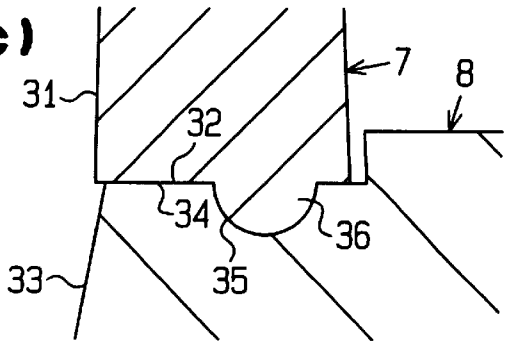

As shown in FIGS. 4(*a*) and 4(*b*), when the control element 8 is moved from the third position R, the locking cam 43 moves away from the follower 40. Then, the protrusion 38 of the engaging element 9 is urged downward by the force of the third leaf spring 39 and thus disengages from the recess 25. Therefore, the protective member 2 is unlocked, allowing movement of the protective member 2. As a result, if the protective member 2 is urged against a sheet of work material, the protective member 2 is pushed toward the rear end of the handle 1 against the spring force of the first and second leaf springs 23 and 24 so that the edge protector 21 moves toward the rear end of the handle 1. As a result, the edge 27 is exposed from the protective member 2 for cutting.

The first embodiment of the present invention has following characteristics.

Only one control element 8 is arranged to operate both the brake mechanism 5 and the lock mechanism 6, so the number of parts is minimized.

The control mechanism 4, which includes the brake mechanism 5 and the lock mechanism 6, is mounted on the handle 1, so the cutter design is simple.

The control element 8 is common to both the brake mechanism 5 and the lock mechanism 6, so adjusting the rotational resistance of the blade 3 and locking or unlocking the protective member 2 are done with only one control element 8. Therefore, the rotary cutter is easily operated.

When the control element 8 is positioned in the third position R, the control element 8 locks the protective member 2 with the engaging element 9. When the control element 8 is positioned in other positions, such as the first or third position P or Q, the protective member 2 is unlocked. Therefore, adjusting the rotational resistance of the blade 3 and locking or unlocking the protective member 2 are done with a continuous movement of the control element 8, thus the rotary cutter is easily operated.

It should be apparent to those skilled in the art that present invention may be embodied in many other specific forms without departing from the spirit or scope of the invention. Particularly, it should be understood that the embodiment of FIGS. 1(*a*) to 4(*c*) can be modified as follows.

The protective member 2 can be designed to move just one of the X and Y directions.

The shoe element 7 and the control element 8 can be integrally formed. Furthermore, the control element 8 and the engaging element 9 can be integrally formed. Further, the shoe element 7, the control element 8 and the engaging element 9 can be integrally formed.

The control mechanism 4 can be mounted on the protective member 2 instead of the handle 1.

Figure 5A:
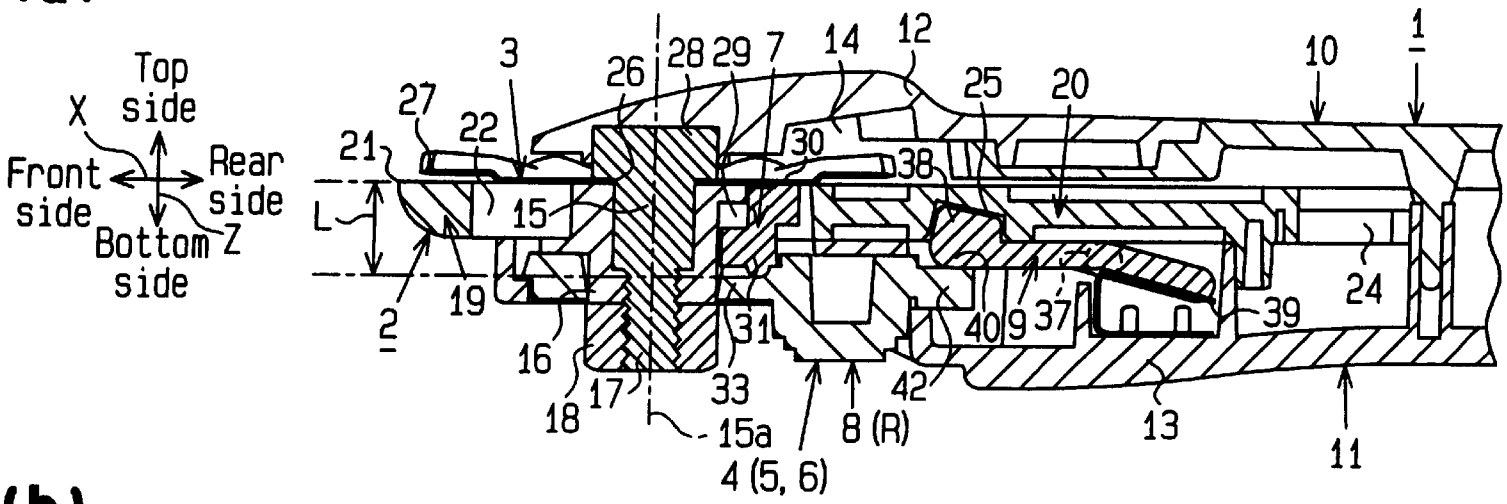
FIG. 5(*a*) is a partial longitudinal sectional view of the rotary cutter according to a second embodiment of the present invention, showing the control element in a locked position.
Figure 5B:
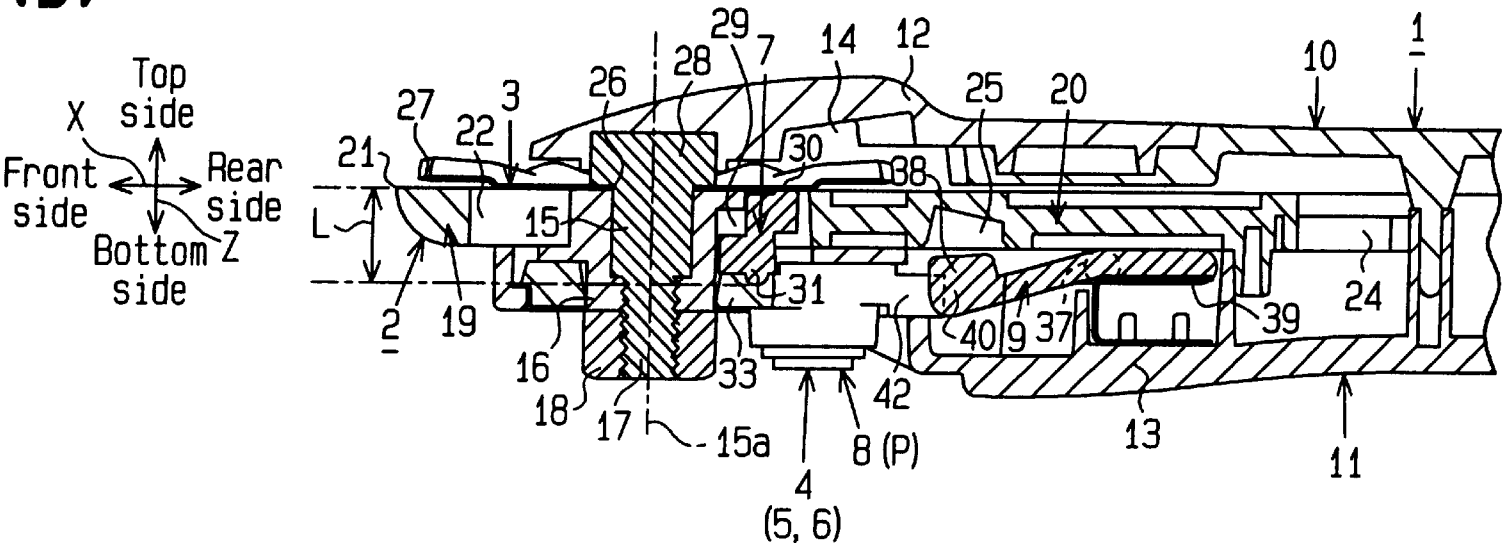

The rotary blade 3 need not necessary be circular and can have many shapes. For example, the rotary blade 3 can have a wavy contour for pinking, as shown in FIGS. 5(*a*) and 5(*b*).

Therefore, the present examples and embodiments are to be considered as illustrative and not restrictive and the invention is not to be limited to the details given herein, but may be modified within the scope and equivalence of the appended claims.

What is claimed is:

1. A rotary cutter comprising:

a handle;

a rotary blade having a cutting edge, wherein the rotary blade is rotatably supported by the handle;

a protective member for covering the blade, wherein the protective member is moveably supported by the handle to move in at least one direction, and wherein the protective member moves between a first position, in which the protective member is locked to prevent exposure of the cutting edge of the blade, and a second position, in which the protective member permits exposure of the edge of the blade;

a lock mechanism for locking the protective member, wherein the lock mechanism moves between a lock position, in which the protective member is held in the first position, and an unlock position, in which the protective member is released;

a brake mechanism for applying rotational resistance to the blade; and a control element common to both the lock mechanism and the brake mechanism for operating both the lock mechanism and the brake mechanism;

wherein the lock mechanism comprises an engaging element that is supported by the handle to allow the engaging element to move in response to the operation of the control element between a lock position, in which the engaging element engages the protective member, and an unlock position, in which the engaging element is spaced from the protective member.

2. A rotary cutter according to claim 1, wherein the control element has a cam section, which is engageable with the engaging element for moving the engaging element from the unlock position to the lock position through the operation of the control element.

3. A rotary cutter according to claim 2 further comprising a spring for urging the engaging element to the unlock position.

4. A rotary cutter according to claim 3, wherein the protective member is allowed to move from the first position to the second position when the engaging element is positioned in the unlock position.

5. A rotary cutter according to claim 4 further comprising an urging member for holding the protective member in the first position.

6. A rotary cutter comprising:

a handle;

a circular rotary blade having a cutting edge, wherein the rotary blade is rotatably supported by the handle;

a protective member for covering the blade, wherein the protective member is moveably supported by the handle, and wherein the protective member moves between a first position, in which the protective member is locked to prevent exposure of the cutting edge of the blade, and a second position, in which the protective member permits exposure of the edge of the blade;

a lock mechanism for locking the protective member, wherein the lock mechanism moves between a lock position, in which the protective member is held in the first position, and an unlock position, in which the protective member is released;

a brake mechanism for applying rotational resistance to the blade, the brake mechanism including a shoe element for applying friction to the blade, wherein the brake mechanism applies rotational resistance to the blade when the shoe element is urged against the blade; and a control element common to both the lock mechanism and the brake mechanism for operating both the lock mechanism and the brake mechanism;

wherein the lock mechanism comprises an engaging element that is supported by the handle to allow the engaging element to move in response to the operation of the control element between a lock position, in which the engaging element engages the protective member, and an unlock position, in which the engaging element is spaced from the protective member.

7. A rotary cutter according to claim 6, wherein the control element has a cam section, which is engageable with the engaging element for moving the engaging element from the unlock position to the lock position through the operation of the control element.

8. A rotary cutter according to claim 7 further comprising a spring for urging the engaging element to the unlock position.

9. A rotary cutter according to claim 8, wherein the protective member is allowed to move from the first position to the second position when the engaging element is positioned in the unlock position.

10. A rotary cutter according to claim 9 further comprising an urging member for holding the protective member in the first position.

* * * * *